US009286791B2

(12) United States Patent
Lagomarsini

(10) Patent No.: US 9,286,791 B2
(45) Date of Patent: Mar. 15, 2016

(54) PROTECTION AND SECURITY SYSTEM INCLUDING THREE-DIMENSIONAL VIRTUAL REALITY

(71) Applicant: HYPERION S.r.l., Spezia (IT)

(72) Inventor: Andrea Lagomarsini, Spezia (IT)

(73) Assignee: HYPERION S.R.L., Sarzana (IT)

( * ) Notice: Subject to any disclaimer, the term of this patent is extended or adjusted under 35 U.S.C. 154(b) by 179 days.

(21) Appl. No.: 14/048,744

(22) Filed: Oct. 8, 2013

(65) Prior Publication Data

US 2015/0097673 A1 Apr. 9, 2015

(51) Int. Cl.
*G08B 29/18* (2006.01)
*G08B 13/196* (2006.01)

(52) U.S. Cl.
CPC ..... *G08B 29/188* (2013.01); *G08B 13/19697* (2013.01)

(58) Field of Classification Search
CPC ..... G08B 13/14; G08B 21/22; G08B 29/188; G08B 13/19697
USPC ..... 340/506, 541, 552; 348/143, 153, 154, 348/155; 715/771
See application file for complete search history.

(56) References Cited

U.S. PATENT DOCUMENTS

| | | | | |
|---|---|---|---|---|
| 3,885,090 | A * | 5/1975 | Rosenbaum | 360/5 |
| 2002/0057340 | A1 * | 5/2002 | Fernandez et al. | 348/143 |
| 2005/0035862 | A1 * | 2/2005 | Wildman et al. | 340/573.1 |
| 2005/0207487 | A1 * | 9/2005 | Monroe | 375/240.01 |
| 2008/0218331 | A1 * | 9/2008 | Baillot | 340/521 |

FOREIGN PATENT DOCUMENTS

| | | | |
|---|---|---|---|
| WO | WO 2007142777 | A2 * | 12/2007 |
| WO | WO 2012153805 | A1 * | 11/2012 |

* cited by examiner

*Primary Examiner* — Daniel Wu
(74) *Attorney, Agent, or Firm* — Greer Burns & Crain, Ltd

(57) ABSTRACT

A system of electronic devices for the detection and location of changes in a predetermined space for the protection and security of places, persons, and goods, including at least two general sensors and two data processing electronic devices connected to each other. One of the two data processing devices includes two electronic means. One of the electronic means reproduces with an appropriate fidelity the place to be monitored into a three-dimensional virtual reality. The second electronic means is capable of acquiring and storing security rules, receiving from the sensors and mapping their signals by correlating them according to criteria of coincidence in the virtual reality to identify events predetermined by the security rules as relevant for the activation of appropriate alarms or notifications.

12 Claims, 2 Drawing Sheets

PROTECTION AND SECURITY SYSTEM INCLUDING THREE-DIMENSIONAL VIRTUAL REALITY

OBJECT OF THE INVENTION

System of electronic devices to detect and locate changes in a predetermined space for protection and security of places, persons, and goods.

STATE OF THE ART

Many place, person, and goods security and protection systems are realized by using of sensors of different types including, for example, thermal sensors, anti-intrusion sensors, chemical sensors, environmental microphones, and cameras. In order to provide the information necessary to protect and secure places, persons, and goods, it is necessary to use the information concerning any changes that occur in the space to be monitored. For example, and for the sake of clearness, a change that occurs in the monitored space might be the opening of a door or the presence of a person in a room who doesn't own an electronic identification paper.

The security and protection systems known so far activate an alarm whenever a change occurs in the space monitored by the security and protection system including, for example, the opening of a door or the appearance of a presence on the video display unit of a camera, which could be interpreted by video-analysis algorithms as an intrusion.

Unfortunately, said systems are not capable of selecting when a change in the monitored space represents a threat for the security and/or protection of that space without generating a high number of false alarms. Specifically, said systems are not capable of correlating to each other the signals coming from a variety of general sensors, i.e. sensors not having special characteristics and currently available on the market, to analyze all changes that could be potentially identified by all general sensors, even of different technologies, which monitor a given portion of the space to be monitored. A number of tests demonstrated that correlating the sensors results in substantially decreasing the number of false alarms, while increasing the selectivity of the protection and security system, by discriminating events pre-qualified by the user as relevant events from those non-relevant.

An accurate location of every individual change in the space represents a fundamental element to correlate the changes detected by the sensors to each other correctly.

Such a lack of selective capability of the security and protection systems known so far is partially counteracted by the adoption of a GPS for the geographical location, for instance, of the foreign body that caused a change in the monitored space.

Unfortunately the adoption of a GPS system has a number of drawbacks:

The intrinsic inaccuracy in the GPS technology.

The fact that seldom is a GPS system capable of locating a change: the foreign body that generated the change, as mentioned above as an example, is not provided with a GPS detector and cannot be located by means of said detector, which, at most, might locate the sensor that detected the change, not certainly the change itself. Such a shortcoming is evidently a major drawback in the protection and security systems known so far.

A GPS system cannot be used in all places. For instance, it cannot be used indoors, especially if such a place, for instance the vault of a bank, is protected.

The GPSs used in the protection and security systems known so far use a system of bi-dimensional coordinates that don't allow the location of a change in the three-dimensional space: consider, for instance, the protection requirements of operators who perform their own activities in a suspended position, for instance on pylons or scaffolds. The accidental displacement of an operator toward a dangerous area cannot be detected by the protection and security systems known so far, which use a GPS system, with the consequent risks of accidents.

The adoption of sensors equipped with a GPS equipment is an additional cost for the system.

SUMMARY OF THE INVENTION

The drawbacks of the art known so far are overcome by a system of electronic devices for the detection, location, and correlation of changes in a space to be monitored for the protection and the security of that space, persons, and goods present in said space, which will be described below.

The system according to the present invention also identifies further improvements of the place, person, and goods protection and security system, also described below. The system according to the present invention is capable of correlating in an innovative and advantageous manner the changes of the signals coming from the sensors on the basis of criteria related to their coincidence in the space, thus allowing an accurate evaluation of the events and their classification either as relevant or non-relevant events on the basis of security rules pre-set by the user. This characteristic will be more widely illustrated in the description of FIG. 2, which illustrates, by way of an example, the operating modes of the system according to the present invention, and in particular with reference to the characteristic of said correlation.

The system of electronic devices for the detection and location of changes in a predetermined space for the protection and security of places, persons, and goods according to the present invention is based on an architecture including at least two sensors, a first data processing electronic device, which is the user interface, and at least one second data processing device.

It is here pointed out that by sensor or sensors we mean a sensor or several sensors, as defined above, commonly available on the market, i.e. without any specific characteristics for being used in the frame of the present invention.

Said first data processing device is connected to the second data processing device. In a preferred embodiment, said first device is separate from the remaining components of the system and is preferably a personal computer, a smart phone, a tablet, or a terminal equipped with a user interface.

The second device, more complex than the first device, is equipped with first electronic means that reproduce the place to be monitored in a three-dimensional virtual reality with an appropriate fidelity on the basis of the mentioned place to be monitored. Let's point out that the degree of fidelity according to which the place to be monitored is reproduced in a three-dimensional virtual reality by the first electronic means depends on the monitoring requirements set by the user. For this reason, the words "appropriate fidelity" have been used to illustrate how the first electronic means reproduce the place to be monitored into a three-dimensional virtual reality.

If the place to be monitored is a square, the fidelity degree required to reproduce the square into the three-dimensional virtual reality is lower than in the case when the place to be monitored is a room. In a square the objects and the elements in general to be monitored have a greater dimension with respect to the objects and the elements in general to be monitored in a room: in a square, for instance, cars or persons have to be monitored, whereas in a room, for instance, paintings, vases, papers, persons have to be monitored. The fidelity degree required to reproduce a square into the three-dimensional virtual reality, in the example mentioned above, is lower than that required for the room according to the above mentioned example, the objects and the elements in general to be monitored in the square having greater dimensions than those present in the room.

Said second data processing device is adequately preset:

to acquire from the first device and store the security rules set by the system user for the place to be monitored;

to receive from the sensors data and/or signals, both referred to as "signals" here below;

to three-dimensionally map, continually as time goes by, the changes of the values that represent the signals received from the sensors in the mentioned three-dimensional virtual reality;

to process, for every portion of the three-dimensional virtual reality, all changes of the signals mapped thereon to take out the data suitable for the application of the security rules set by the user for said place to be monitored;

to correlate to each other the changes of the signals received from different sensors and referred to the same portion of space;

to apply the security rules set by the user for said place to be monitored on the basis of the processing of the changes of the mapped signals;

to activate the alarm signals specified by said rules on the first electronic device and/or on other external devices.

As mentioned above, the second data processing device maps the changes of the signals coming from the sensors as time goes by into the three-dimensional virtual reality. Such a mapping is carried out on the basis of: the subdivision of said virtual reality according to a cell-based three-dimensional grid; the association of the three-dimensional grid of every sensor and its respective signals with said cells.

In order to process the signals coming from the sensors appropriately, the second data processing device comprises one or several third data processing devices independent from and intercommunicating with each other. Each of said devices will be referred to as "Agent device" below.

Each Agent device is connected to at least one sensor and is capable of processing the signals of every sensor that it is connected to.

In order to process the signals coming from the sensors adequately, the second data processing device also comprises a fourth data processing device, referred to as Gateway below, capable of: identifying those Agent devices whose sensors have their signals associated with in sets of cells of the three-dimensional grid featuring a non-null intersection, referred to as "correlated Agents" below;

to activate a correlation between said thus identified Agent devices.

Every Agent device is capable of autonomously analyzing the signals coming from the sensors.

From the analysis of the changes of the said signals, every Agent device:

extrapolates the appearance of objects or events;

classifies said objects or events by type;

places said objects or events in the cells of the grid of the virtual reality;

alternatively calculates the probabilities of error or the reliability of correctness of the analysis made, in short referred to as "reliability" below.

By means of said features, every Agent device is capable of continually communicating to the remaining Agent devices correlated thereto its own results of the analysis and its respective reliability.

Therefore, every Agent device is capable of processing the results of the analysis and the reliability received from every correlated Agent together with its own results of the analysis and reliability, to get overall analysis results and an overall reliability. In the system according to the present invention, the overall analysis and the overall reliability are performed by an Agent device automatically identified on the basis of predetermined criteria and said Agent device communicates the results of the overall analysis and the overall reliability to the Gateway. Said communication takes place continually and, likewise, continually is identified, on the basis of the preset criteria, the Agent device that communicates the results of the overall analysis and the overall reliability to the Gateway.

Finally, the Gateway applies the security rules set by the user for said place to be secured and protected on the basis of the mentioned results of overall analysis and overall reliability, by activating the specified notification and/or alarm communications, for instance it activates a visual alarm, for instance a blinking light, or sends a signal to the first data processing device, for instance an audible signal or a message.

BRIEF DESCRIPTION OF THE DRAWINGS

FIG. 1 shows a system of electronic devices (1) for the detection and location of changes in a predetermined space for the protection and the security of places, persons, and goods. Said FIG. 1 shows four sensors (2) and a first data processing electronic device (3). Said device (3) might be a personal computer, like that shown in the figure, but it also might be a tablet, a smart phone, or any other terminal equipped with a user interface.

Figure 1:
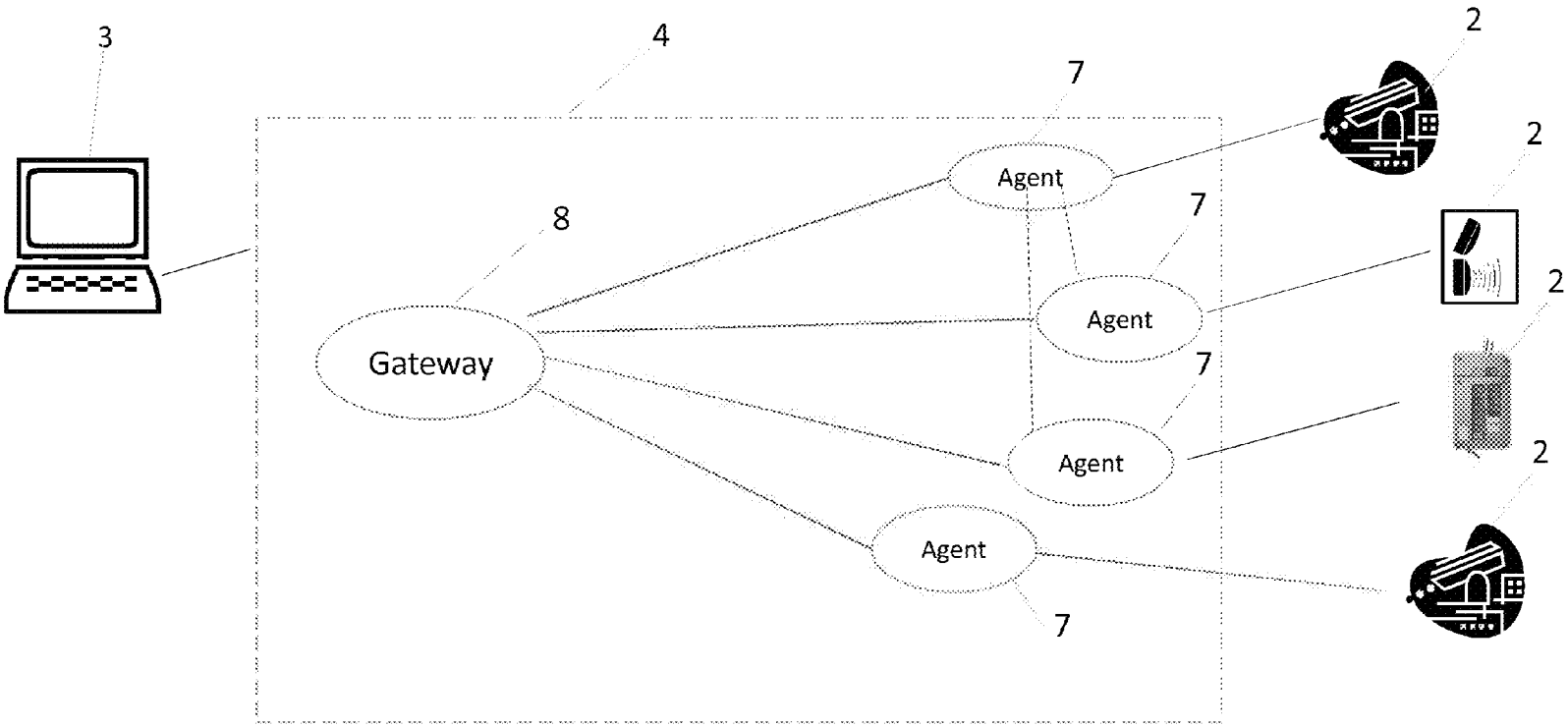
FIG. 1 shows the assembly of the system according to the present invention.

A second data processing device (4) is shown in dotted lines. Said second device (4) might be implemented on any hardware suitable for processing data, for instance a server.

The device (4) is connected to the first data processing device (3) and comprises first electronic means (5), not shown in the figure, which reproduce with an appropriate fidelity the place (A) to be monitored, not shown in the figure, into a three-dimensional virtual reality, not shown in the figure. In said second device (4) there are also second electronic means (6), not shown in the figure, capable of acquiring, storing the security rules set by the user for said place (A), receiving from the sensors (2) data and/or signals, three-dimensionally mapping in a continual manner as time goes by in said three-dimensional virtual reality the values that represent the signals coming from the sensors and the changes, processing, for each portion of the three-dimensional virtual reality, all signals mapped thereon to take out the data suitable for the application of the security rules set by the user for said place (A), applying the security rules set by the user for said place (A) on the basis of the processing of the mapped signals and activating the alarm signals specified by it on the first data processing device (3) and/or on other external devices.

The mapping into the three-dimensional virtual reality of the values that represent the signals coming from the sensors (2) as time goes by is performed by the second data processing device (4) on the basis of the subdivision of said virtual reality according to a cell-based three-dimensional grid, of the association with said cells of the three-dimensional grid of every sensor (2) and of its respective signal. Such a mapping is not shown in the figure because of evident difficulties of representation.

FIG. 1 also shows the presence, in the second data processing device (4), of third data processing devices (7), referred to as Agent devices. Said Agent devices (7) are graphically represented as four devices. They are suitable for processing the signals coming from the sensors. They are independent of and intercommunicating with each other. Each of said Agent devices (7) is connected to a sensor (2). According to the present invention, the Agent devices can in any case be connected to one or several sensors (2).

Each of said Agent devices (7) is suitable for autonomously analyzing the signals continually coming from the sensors, so as:

- to identify the appearance of objects or events (change);
- to classify said objects or events by type (classification);
- to position said objects or events with reference to the cells of the grid of the virtual reality (positioning);
- to alternatively calculate the probability of error or the reliability of correctness of the analysis made (reliability).

Each of said Agent devices (7) is also capable of continually communicating with the remaining Agent devices (7) correlated thereto every change, classification, positioning, all together referred to as "results of the analysis", and its respective reliability, by processing the results of the analysis made received from every Agent device (7) correlated to its own results of analysis and reliability, all together referred to as "overall analysis and overall reliability", and of continually communicating to the Gateway device (8), already mentioned in the summary of the invention, the overall analysis and the overall reliability. Said communication is implemented by an agent automatically identified on the basis of predetermined criteria.

FIG. 1 also shows the presence in the second data processing device (4) of a fourth data processing device (8), referred to as Gateway. Said fourth device is capable of identifying the Agent devices (7) having the signals of the sensors that every Agent device (7) is connected to that are associated with in sets of cells of the three-dimensional grid featuring a non-null intersection, referred to as "correlated agents", and of activating a correlation between said thus identified Agent devices (7).

The Gateway (8) is also capable of applying the security rules set by the user for said place (A) on the basis of the above defined overall analysis and overall reliability, by activating the notifications or alarms pre-determined by the user.

Figure 2:
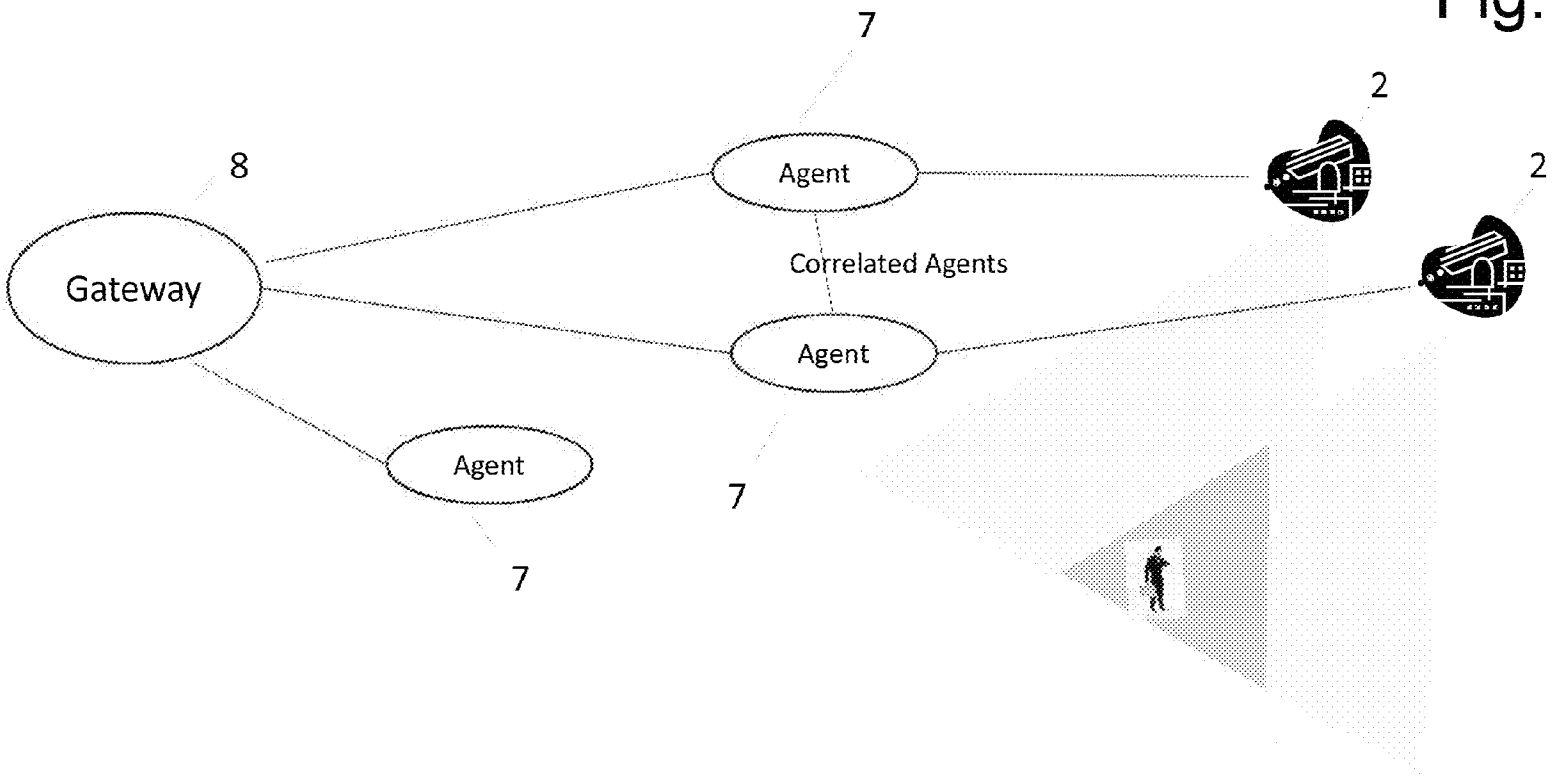
FIG. 2 shows a schematic example of operation of the system according to the present invention.

FIG. 2 shows an example of operation of the system according to the present invention for the classification of the changes. Two sensors ($\mathbf{2}^1$ and $\mathbf{2}^2$), which are two cameras in this example, monitor a common area of the place to be monitored (A). The Agent devices ($\mathbf{7}^1$ and $\mathbf{7}^2$) are correlated to each other, being connected to the sensors ($\mathbf{2}^1$ and $\mathbf{2}^2$) which, as already said, monitor a common area.

In the example shown in FIG. 2, each of the sensors ($\mathbf{2}^1$ and $\mathbf{2}^2$) detects a change. The changes detected by every sensor ($\mathbf{2}^1$ and $\mathbf{2}^2$) are located on the basis of the mapping of the second electronic means (6), by determining that both sensors ($\mathbf{2}^1$ and $\mathbf{2}^2$) detected a change in the same position.

As a matter of fact, each of said sensors detected a change and communicated its respective signal to the Agent device ($\mathbf{7}^1$ or $\mathbf{7}^2$) that it is connected to.

Said Agent devices ($\mathbf{7}^1$ and $\mathbf{7}^2$) identify that the appearance of objects or events did take place, in other words there was a change, as defined above in the summary of the invention. The change is positioned with reference to the cells of the virtual reality and is classified: in this example, it would be the presence of one person as shown in the graphical representation of FIG. 2. The system according to the present invention determines that it is matter of one person, in that each of the two Agent devices ($\mathbf{7}^1$ and $\mathbf{7}^2$), correlated to each other, communicates to the other the detected change, its type and its position. In the example shown in FIG. 2, each of said Agent devices ($\mathbf{7}^1$ and $\mathbf{7}^2$) communicates to the other having identified a change due to an object that can be classified, with a certain reliability, as a person in a precise position of the virtual reality. Being the position identical for both changes, each Agent ($\mathbf{7}^1$) and ($\mathbf{7}^2$) recognizes that the two changes coincide in the same change. Said change is synthetically classified by the Agent devices ($\mathbf{7}^1$ and $\mathbf{7}^2$) on the basis of the classifications and their respective reliabilities, provided by the two said Agent devices.

The invention claimed is:

1. A system of electronic devices for the detection and location of changes in a predetermined space for the protection and the security of places, persons, and goods including at least two sensors, a first data processing electronic device and at least one second data processing device connected to the first data processing device, where the second data processing device comprises:

(a) first electronic means reproducing with an appropriate fidelity the place to be monitored into a three-dimensional virtual reality;

(b) second electronic means that is configured and arranged for:

($b^1$) acquiring and storing security rules set by a user for said place;

($b^2$) receiving data and/or signals from the sensors;

($b^3$) three-dimensionally mapping in said three-dimensional virtual reality, continually as time goes by, values that represent the signals;

($b^4$) processing, for each portion of the three-dimensional virtual reality, all signals mapped thereon to take out the data suitable for the application of the security rules set by the user for said place; and ($b^5$) applying the security rules set by the user for said place on the basis of the processing of the mapped signals and activating alarm signaling on the first data processing device and/or other external devices.

2. A system according to claim 1, where a Gateway device applies the security rules set by the user for said place on the basis of the overall analysis and overall reliability.

3. A system according to claim 1, where the second data processing device maps in the three-dimensional virtual reality the values that represent the signals coming from the sensors as time goes by, on the basis of:

(a) the subdivision of said virtual reality according to a cell-based three-dimensional grid; and (b) the association with said cells of the three-dimensional grid of every sensor and its respective signal.

4. A system according to claim 3, where the second data processing device comprises:

(a) one or several third data processing devices, each defined as an Agent device, that are independent of and intercommunicating with each other, wherein each Agent device is connected to at least one sensor and capable of processing signals, and (b) a fourth data processing device, defined as a Gateway device, that is capable of identifying the Agent devices having the signals of the sensors that each Agent device is connected to that are associated with in sets of cells of the three-dimensional grid featuring a non-null intersection and of activating their correlation.

5. A system according to claim 3, where a Gateway device applies the security rules set by the user for said place on the basis of the overall analysis and overall reliability.

6. A system according to claim 4, where every Agent device is configured and arranged for autonomously analyzing the signals continually coming from the sensors, so as:

identifying the appearance of a change in at least one object or at least one event;

classifying said objects or events by type;

positioning every object or event with reference to the cells of the grid of the virtual reality; and to alternatively calculate the probability of error or the reliability of correctness of the analysis made.

7. A system according to claim 4, where the Gateway device applies the security rules set by the user for said place on the basis of the overall analysis and overall reliability.

8. A system according to claim 6, where every Agent device:

(a) continually communicates to the remaining Agent devices results of analysis correlated thereto every change, classification, and positioning, and its respective reliability;

(b) processes the results of the analysis received from every correlated Agent device with its own results of analysis and reliability, defined as analysis and overall reliability, respectively; and (c) continually communicates to the Gateway device the overall analysis and overall reliability.

9. A system according to claim 6, where the Gateway device applies the security rules set by the user for said place on the basis of the overall analysis and overall reliability.

10. A system according to claim 8, where the communication of the overall analysis and the overall reliability to the Gateway device is implemented by at least one Agent device automatically identified on the basis of predetermined criteria.

11. A system according to claim 8, where the Gateway device applies the security rules set by the user for said place on the basis of the overall analysis and overall reliability.

12. A system according to claim 10, where the Gateway device applies the security rules set by the user for said place on the basis of the overall analysis and overall reliability.

* * * * *